US005200013A

United States Patent [19]

Traber

[11] Patent Number: 5,200,013

[45] Date of Patent: Apr. 6, 1993

[54] METHOD AND DEVICE FOR CORRUGATED DEFORMATION OF A FLAT MATERIAL SHEET

[75] Inventor: Roman Traber, Buchs, Switzerland

[73] Assignee: Dividella AG, Grabs, Switzerland

[21] Appl. No.: 802,624

[22] Filed: Dec. 5, 1991

[30] Foreign Application Priority Data

Dec. 18, 1990 [CH] Switzerland ..... 4016/90

[51] Int. Cl.[5] ..... B31F 1/20

[52] U.S. Cl. ..... 156/210; 156/443; 156/539; 264/339; 425/396; 493/463

[58] Field of Search ..... 156/210, 196, 443, 471, 156/205, 539, 580; 264/339, 286; 425/396, 336; 493/463

[56] References Cited

U.S. PATENT DOCUMENTS 1,794,435 3/1931 Barth ..... 425/396 X
4,616,991 10/1986 Bach et al. ..... 425/396

FOREIGN PATENT DOCUMENTS 548274 11/1956 Belgium .
506487 8/1920 France ..... 425/396
631482 1/1962 Italy ..... 425/396

*Primary Examiner*—Michael W. Ball
*Assistant Examiner*—Michele K. Yoder
*Attorney, Agent, or Firm*—Shoemaker and Mattare Ltd.

[57] ABSTRACT

For the corrugated deformation of a flat sheet of material, an upper row (2) of shaping tools (4) is pressed against a lower row (3) of shaping tools (5). The shaping tools of both the rows are, with that, also simultaneously pushed together so that they trace the shortening of the sheet of material during the deformation. Thus, the situation is achieved where no relative displacement between the sheet of material and the facing sides (6, 6') of the shaping tools (4 and 5) takes place, also in the case of numerous corrugations of relatively great height. The lower row of shaping tools is arranged on a rotor, whilst the upper row is fixed at a working station within the area of rotation of the rotor.

18 Claims, 8 Drawing Sheets

METHOD AND DEVICE FOR CORRUGATED DEFORMATION OF A FLAT MATERIAL SHEET

This invention relates to a method and apparatus for corrugating sheet material.

BACKGROUND OF THE INVENTION

The production of corrugated flat formed bodies has been known for a long time, is in use, and employed for a wide range of uses. A main area of application is packaging technology, where corrugated components are necessary for fixing longitudinal articles such as ampules, ballpoint pens etc. Corrugated components can be produced in a continuous working process from flat formed bodies fed from the roll. The individual corrugated components must subsequently be cut to a definite length. These types of devices do not permit integration into packaging lines, however, since the production cycle for the corrugated components generally does not correspond to the filling cycle of the packaging line.

Naturally, methods and devices are also already known with which the corrugated component is not produced off the roll but from a cut sheet, in a single working step. For example, BE-A-548 274 describes a device with which two parallel corrugated components can be produced directly inside a package. The lower rows of shaping tools are, with that, brought into position with a bow shaped movement, respectively retracted again after the deformation, whilst the upper rows of prismatic shaping tools can be lowered in a vertical movement.

A considerable disadvantage of the known methods and devices is that the distance, respectively the intermediate space between the individual shaping tools of a row remains constantly the same. The distance corresponds to the dimension of the finished corrugation, which, during the deformation process, of necessity leads to a relative displacement between the facing surfaces of the shaping tools and the material sheet. The absolute length of the material sheet will be increasingly shortened with increasing deformation, which leads to friction on the deformation tools. The more corrugations lying next to one another, and the higher the corrugations, the greater the shortening and the friction between the tool and the work piece will evidently be. The possibilities for application of the devices known up to now were, for this reason, extremely limited.

For the production of corrugated sheet metal, methods and devices are already known with which friction between the tool and the work piece is avoided. Thus, FR-A-1,259,214 shows a method with which numerous corrugations are simultaneously formed in a sheet, whilst the shaping tools are pressed against one another and simultaneously pushed up together. The device described is, however, not suitable for the deformation of small material sheets within a packaging line.

SUMMARY OF THE INVENTION

It is therefore a purpose of the invention to create a method of the type mentioned in the introduction which enables the deformation of a flat material sheet in a practical way without a displacement in relation to the prismatic shaping tools. The method shall, apart from that, enable high working cycles and permit relatively easy integration into a dominant working process. A further purpose of the invention involves the creation of a device, functioning in a technically simple way with a low space requirement, for carrying out the method.

Through the simultaneous pushing together of the shaping tools during plane parallel opposing movement of the upper and lower rows, the shaping tools follow, in a practical way, each individual sequence of the deformation. No relative displacement ensues on the facing sides of the shaping tools, since these trace the absolute shortening of the material sheet. Evidently, corrugated components with numerous, relatively high corrugations can be produced in this way, without a resulting tension in the material sheet.

The displacement of the shaping tools ensues, with advantage uniformly, relative to a plane of symmetry which runs transverse to the material sheet and parallel to the shaping tools. The shaping tools are moved, from both sides, in a uniform way towards the plane of symmetry. The control of the movement sequence is thus considerably simplified. In certain cases it would also be conceivable to slide the shaping tools together in one direction only.

The pushing together movement for the shaping tools of both the rows can be controlled in a particularly simple way if these are pushed, each by means of a traction mechanism with parallel functioning means of traction. The traction mechanism, which can, for example, be a toothed belt, a wire tackle or similar, causes an absolutely uniform movement of the shaping tools which are attached to it.

The actual drive of the shaping tools ensues, with advantage, directly or indirectly through a crank drive. Therewith, the movement which is carried out during the meander shaped deformation of the flat sheet can be traced mechanically. Naturally, however, the drive could also ensue by means of electronically controlled electric motors, through a cam drive.

A particularly practical working method can be achieved if at least one lower row of shaping tools is pushed or pivoted from a loading position, in which the flat material sheet is placed on the facing sides of the shaping tools, into a deforming position in which the lower row is situated opposite a upper row of shaping tools and if, after deformation of the material sheet, the lower row is pushed or pivotted, with the shaped material sheet, into at least one depositing position, in which the material sheet is deposited.

In many cases it is necessary to stabilise the deformed material through connection with a carrier sheet. This ensues preferably in the depositing position, where in each case a carrier sheet can be made ready. The deformed material sheet can, with that, be coated with adhesive in a coating position which lies between the deforming position and the depositing position. During transport to the different positions, the material sheet is held, preferably through vacuum, on the facing side of the row of shaping tools. The transport can ensue in a rotary movement, by which at least one row of shaping tools is fixed to a rotor which positions up to the individual working stations in cycles. Alternatively, however, the row of shaping tools can also position with a linear movement in a stepped sequence up to the individual working stations and then return once again to the start position.

The invention also concerns a packaging component which is produced according to the method described, with a deformed material sheet which is fixed to the carrier sheet, the material sheet, together with the carrier sheet, defining the limit of longitudinal chambers which possess a polygonal cross section with at least six corners. With that, a honeycomb shaped package arises with particularly good longitudinal stability. The material sheets, together with the carrier sheet, can also define the limit of longitudinal chambers with a polygonal cross section, the material sheet being provided with incisions which define the limit of part sections on the chambers. The incisions can, with that, form straps which can be folded over for fixing of the packaging contents, or the incisions can also form the division for chamber sections with differing cross sectional shape.

BRIEF DESCRIPTION OF THE DRAWINGS

An embodiment of the invention is portrayed in the drawings and is more closely described in the following. Namely.

DESCRIPTION OF THE PREFERRED EMBODIMENT

Figure 1:
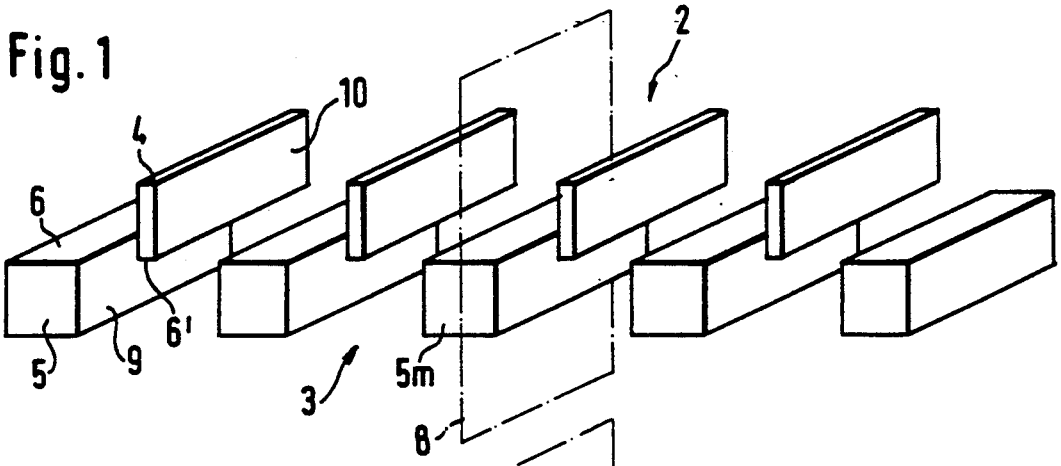
FIGS. 1 to 3: the movement sequence of the shaping tools, during the shaping of a sheet, in three different positions.
Figure 2:
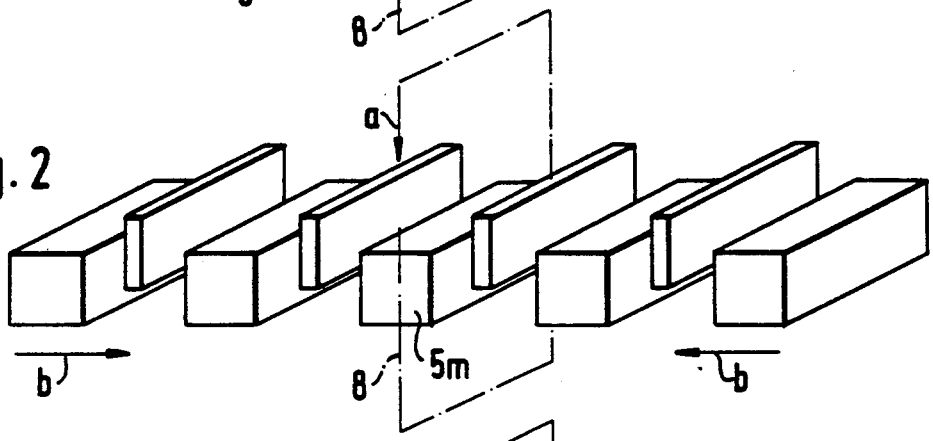
Figure 3:
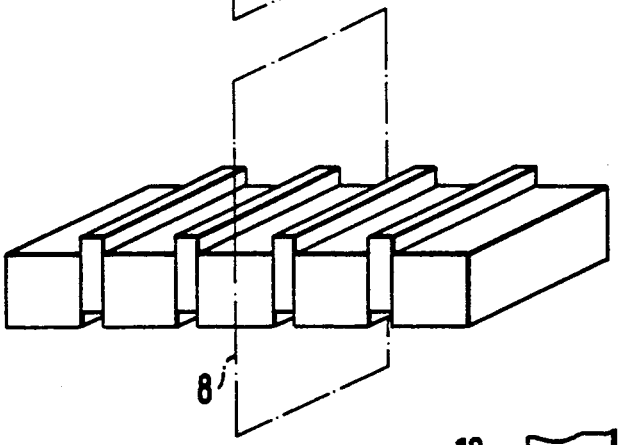

In FIGS. 1 to 3, an upper row 2 of shaping tools 4 and a lower row 3 of shaping tools 5 is schematically portrayed. The shaping tools are arranged to be parallel to one another and have a prismatic configuration. The cross sectional form and the length of these shaping tools is naturally adjusted according to the corrugated component to be produced. The facing sides 6, 6', oriented towards one another, of both the rows of shaping tools lie in one plane in the start position. This plane is formed in practice by the flat material sheet 1, which is here not shown for reasons of clarity. With the reference lines 8, a plane of symmetry is implied which runs transversely to the flat material sheet and parallel to the shaping tools.

To shape the material sheet, the upper row 2 is pressed against the lower row 3 of shaping tools in the direction of the arrow a, that is, parallel to the plane of symmetry 8. Naturally, also the lower row could be pressed against the upper row, or both rows could be pressed uniformly against one another. Simultaneously with this movement, however, both the rows of shaping tools 4 and 5 are also pushed together in the direction of the arrows b, towards the plane of symmetry. The central moveable shaping tool 5*m* remains at rest in the plane of symmetry.

Figure 4:
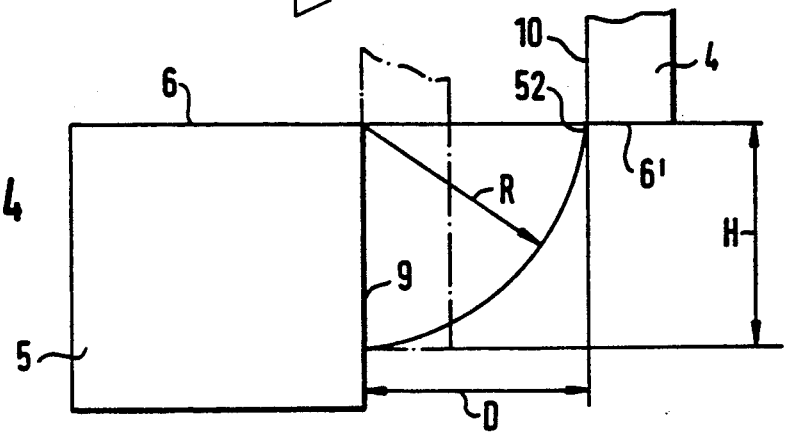
FIG. 4: the movement sequence on two neighbouring shaping tools in a greatly enlarged representation.

FIG. 3 shows the shaping tools in the end position, in which the material sheet deformation is complete. The relative movement sequence between a moveable shaping tool 5 and a upper shaping tool 4 is once again portrayed in FIG. 4. The flank 10 of the upper shaping tool 4, with its tool edge 52, moves in a circular curved motion with the radius R against the flank 9 of the lower shaping tool 5. The radius R corresponds to the distance D between both the shaping tools 4 and 5 and, at the same time, to the height H of the desired deformation. A material sheet lying in the plane of the facing sides 6 and 6' will, with this movement sequence, evidently not be subjected to a displacement in relation to the facing sides.

A deforming station with the different drive and transmission systems is described with reference to FIG. 5. Two parallel guide rods 12, 12' are firmly fixed to a rotor arm 64. A fixed holder 15 is arranged in the centre of these guide rods which carries a fixed shaping tool 5*m*. The rest of the lower shaping tools 5 are arranged on displaceable lower holders 16 which are able to be displaced along the guide rods 12, 12'.

A fixed frame 11 is arranged in the zone of rotation of the rotor arm 64. This frame carries the upper shaping tools 4. The moveable upper holders 20 are guided, and able to be displaced, on the moveable guide rods 13 and 13'. The moveable guide rods can be moved downwards on the parallel guides 14, 14' in the direction of the arrow a. The upper shaping tools 4 are attached on the ends of the moveable upper holders 20.

A drive crank 27 is arranged on the righthand side. This drive crank engages in a vertical fork 33 which is provided with thrust elements 65, 65' above and below. The function of these thrust elements will be explained in the following with reference to FIG. 9.

A lower traction mechanism 17 is arranged in the sliding zone of the moveable lower holder. This comprises a first parallel belt 18 and a second parallel belt 19. One parallel belt is intended for each symmetrical pair of moveable holders. In the case in question there are two pairs, whilst the diameters of the belt pulleys 50, 50', respectively 53, 53' are determined according to the travel to be accomplished by the holder. Each pair of holders is connected in each case to the upper, respectively lower span of a parallel belt at a point of connection 30.

A rotary movement of the drive crank 27 evidently causes a thrust movement of the thrust elements 65, the holder 16*r* being pushed up to a carrier 29 and setting the traction mechanism 17 in motion and, as a result, all moveable holders being simultaneously put into motion.

The upper traction mechanism 21 is put into motion in a similar way through the thrust element 65'. The upper traction mechanism 21 comprises both the belt pulley pairs 54, 54' and 55, 55', which once again carry a first and a second parallel belt 22, respectively 23. Carriers 24, which engage into the guide slots 25 on the moveable upper holders 20, are fixed to the upper and lower span of these parallel belts.

The moveable upper holders 20 likewise carry out a uniform pushing together movement on activation of the upper traction mechanism, whilst they naturally also can still move downwards in the direction of the arrow a.

The drive crank 27 also still engages in a lower horizontal fork 32 which is fixed on a vertical transmission rod 36. This transmission rod is guided on the guides 35, 35'. An upper horizontal rod 31 is arranged on the upper end of the transmission rod 36. This acts in coordination with an oscillating lever 26 which is linked to the frame 11. The oscillating lever 26 has the function of a one-sided lever, in that it also engages in an angled fork 34. With this transmission, the vertical thrust movement of the transmission rod 36 is transferred onto the moveable guide rods 13, 13' with a definite reduction ratio.

Figure 5:
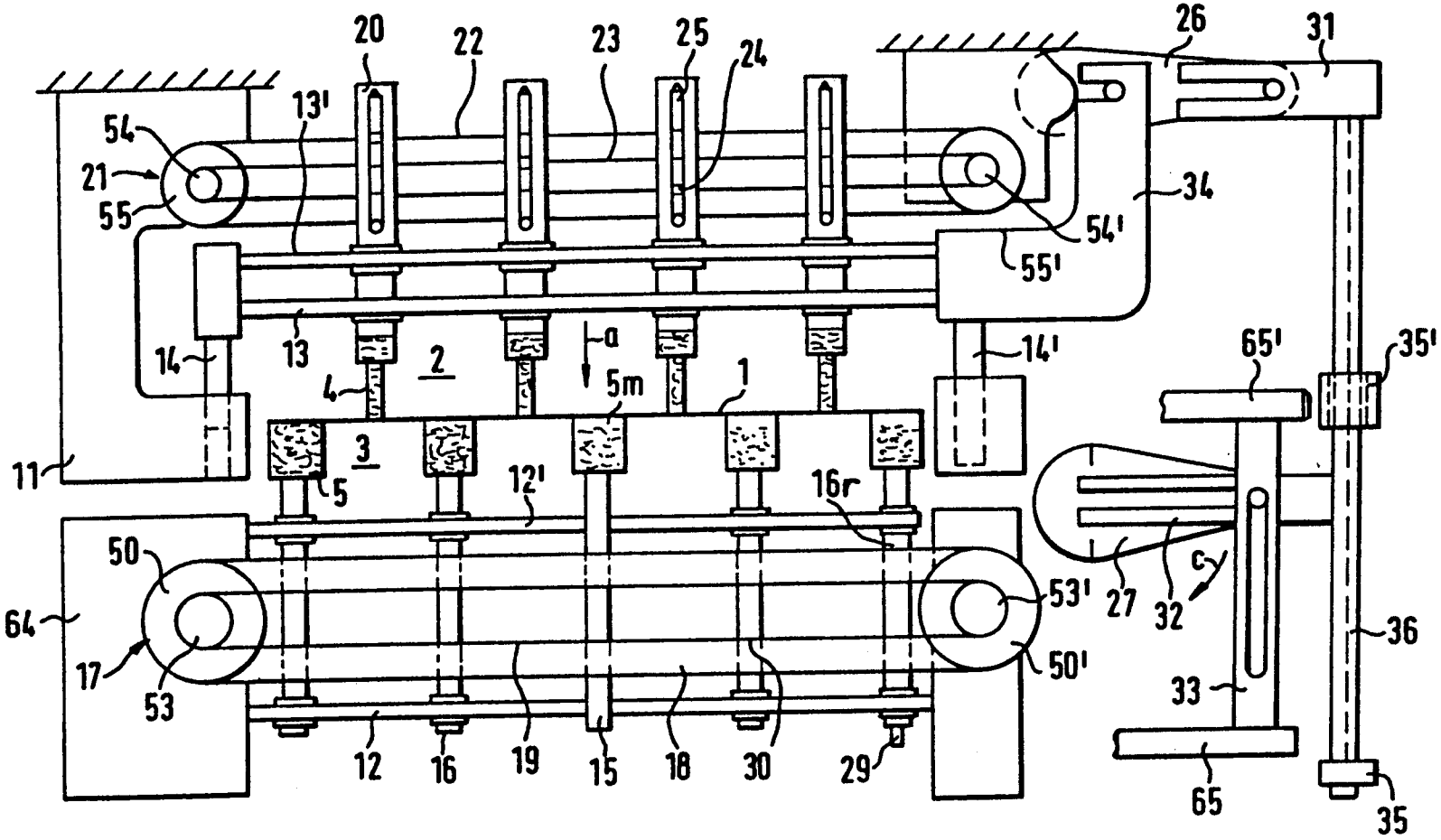
FIGS. 5 to 7: a deforming station for deformation a flat material sheet, in a greatly simplified representation, in the three different working positions according to FIGS. 1 to 3, FIG. 8: a general perspective portrayal of a rotor with numerous working stations.

During deformation of a flat material sheet 1, according to FIG. 5 this lies first of all upon the lower row 3 of shaping tools 5. With that, the upper row 2 of the shaping tools 4 lie approximately on the material sheet 1. Subsequently, the drive crank 27 is pivotted downwards in the direction of the arrow c.

Figure 6:
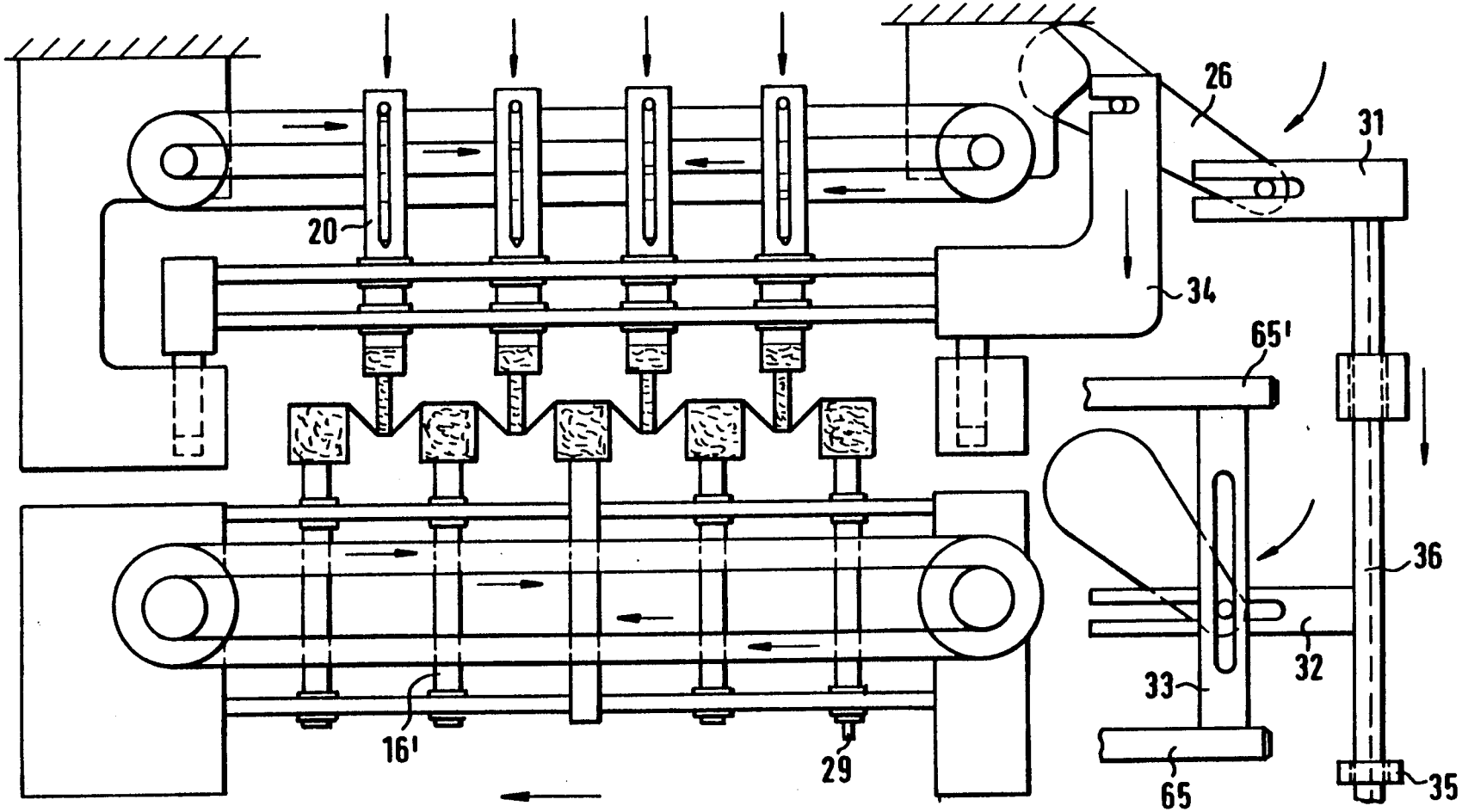

FIG. 6 shows the position of the shaping tools in accordance with the position in FIG. 2. Both the forks 32 and 33 cause a simultaneous horizontal and vertical thrust movement. The horizontal thrust movement causes a pushing together of all the shaping tools by means of both the traction mechanisms, and the vertical thrust movement causes a lowering of the upper shaping tools between the moveable shaping tools. As portrayed in FIG. 6, the material sheet 1 is already partly deformed, no displacement in relation to the facing sides of the shaping tools taking place, however.

Figure 7:
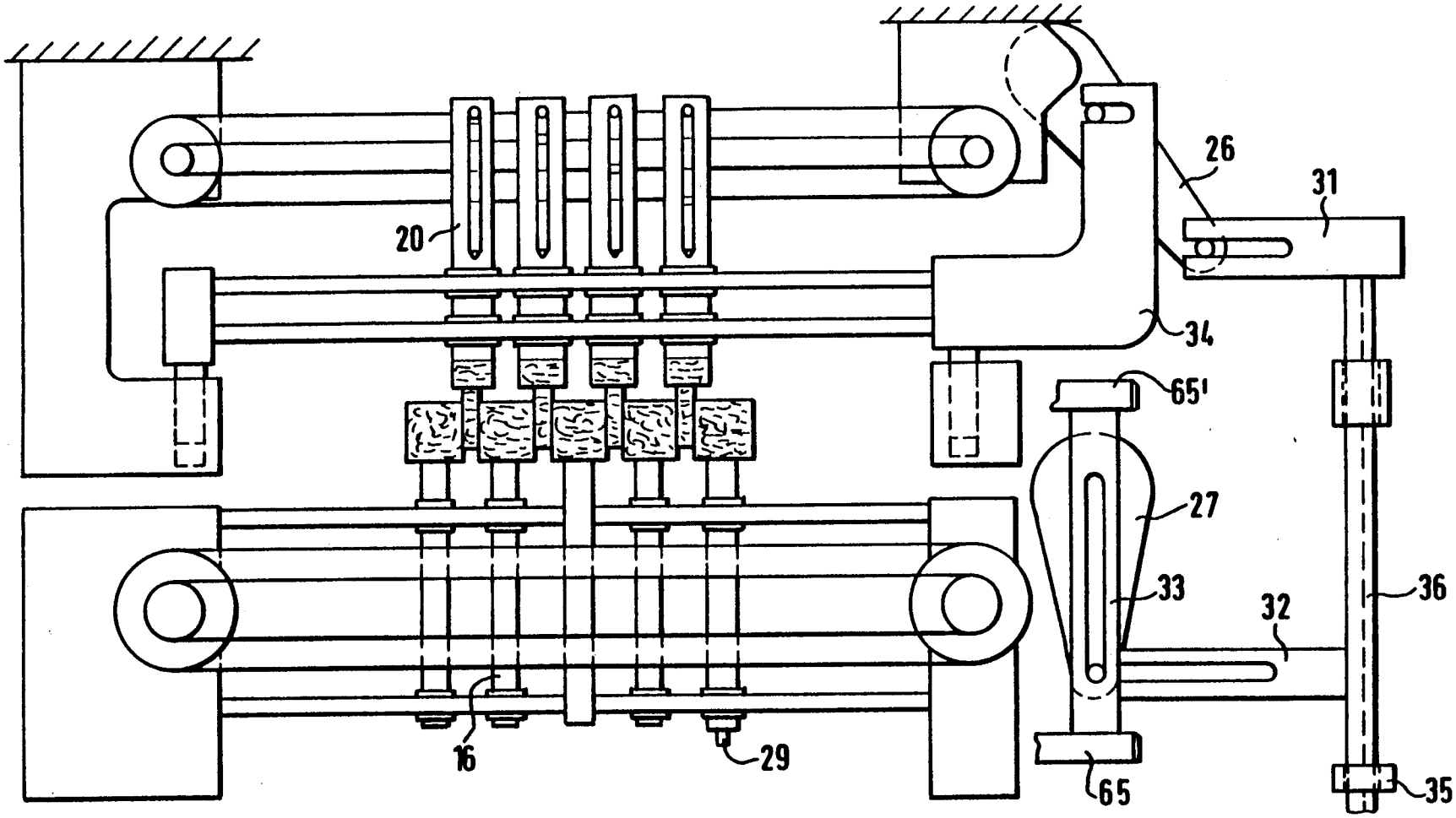

FIG. 7 shows the end position of the shaping tools. The drive crank 27 has carried out a movement of 90° from the horizontal to the vertical. In relation to FIG. 4, this movement corresponds to the travel which a tool edge 52 accomplishes until the material sheet is completely deformed. This travel can naturally be altered to suit the desired cross sectional shape of the deformation, respectively the shaping tool. It is also evident from FIG. 7 that the moveable guide rods 13, 13' have been displaced in the parallel guides 14, 14' into the lowest position by the oscillating lever 26. Here, too, according to the ratio of gearing up or down, differing travel lengths are possible. The thrust crank transmission permits adjustment to the individual parameters in the simplest way.

Figure 8:
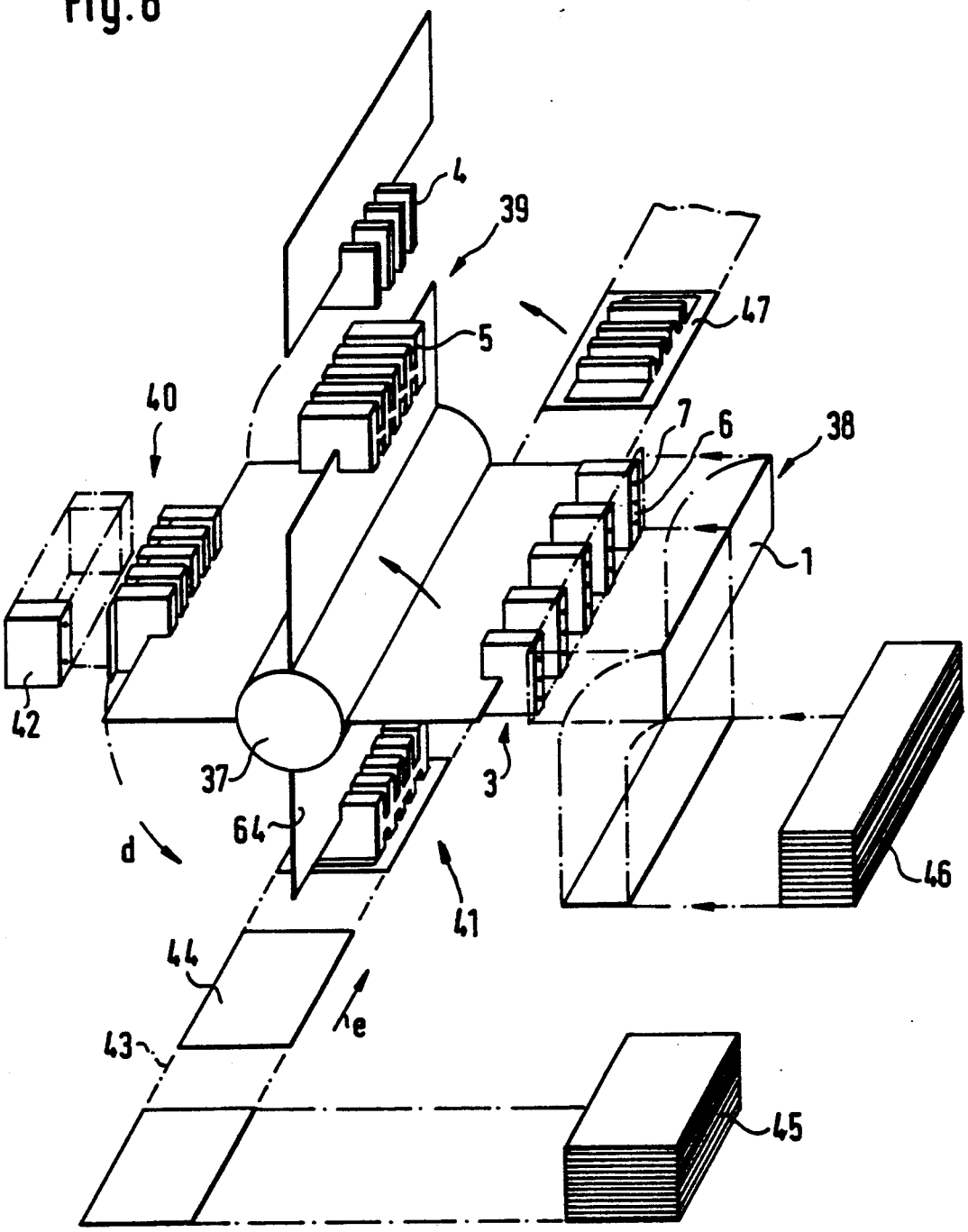

FIG. 8 shows a device with numerous working stations, with which a deforming station 39 is constructed approximately similar to the principle of the device according to FIG. 5. There are a total of four rows 3 of shaping tools arranged at intervals of equal angle on the rotor arms 64 of a rotor 37. The rotor is able to be rotated in the direction of the arrow d and thus guides the rows, in cycles, to the different working stations. With that, at each working station a certain movement will be carried out simultaneously.

The facing sides 6 of the moveable shaping tools 5 are provided with openings 7. These openings are connected to a vacuum scource which is not shown more closely here. Through this, the material sheets 1 are held firmly by the lower row of shaping tools, indifferent to the relative position that the shaping tools may assume.

At a loading station 38, flat material sheets 1 are picked up from a stack 46 and placed on the lower row of shaping tools into the loading position by a mechanism which is not shown more closely here. After a rotation of 90°, these shaping tools reach deforming station 30, where they come to rest exactly parallel beneath the upper row 2. In this position, the deformation of the material sheet ensues according to the previously described principle.

After a further rotation of the rotating body through 90°, the now deformed material sheet reaches a coating station 40 on which an adhesive spray head 42 is arranged. This spray head sprays an adhesive onto the lower side of the sheet. The lower shaping tools naturally remain in the pushed together position which they have assumed at deforming station 39. In place of the adhesive spray head, another suitable device could also be provided for application of the adhesive.

After a further rotation of 90°, the material sheet reaches the depositing station 41 which lies on the movement plane of a conveyor 43. Carrier sheets 44, which are picked off a stack 45, are fed on this conveyor in the direction of the arrow e. At the depositing station 41, the lower shaping tools, pushed together, are lowered slightly so that the shaped material sheet 1 with the adhesive coating is pressed onto the carrier sheet 44. At the same time, through appropriate control, the connection to the vacuum scource is interrupted and the shaping tools are retracted again. A finished corrugated component 47 leaves the working station in the next cycle and can be further worked in a packaging line.

The moveable shaping tools are again expanded away from one another between the depositing station 41 and the loading station 38, until they have assumed their start position. This device works in an extremely practical way and permits integration into a packaging line with economic demands on space, whilst the production of corrugated components 47 can keep pace with the filling cycle without problems. Naturally, in the region of the rotating body 37, other working stations could also be provided. It would also be conceivable to dispense with the coating station 40 and instead coat the carrier sheet 44 with adhesive.

Figure 9:
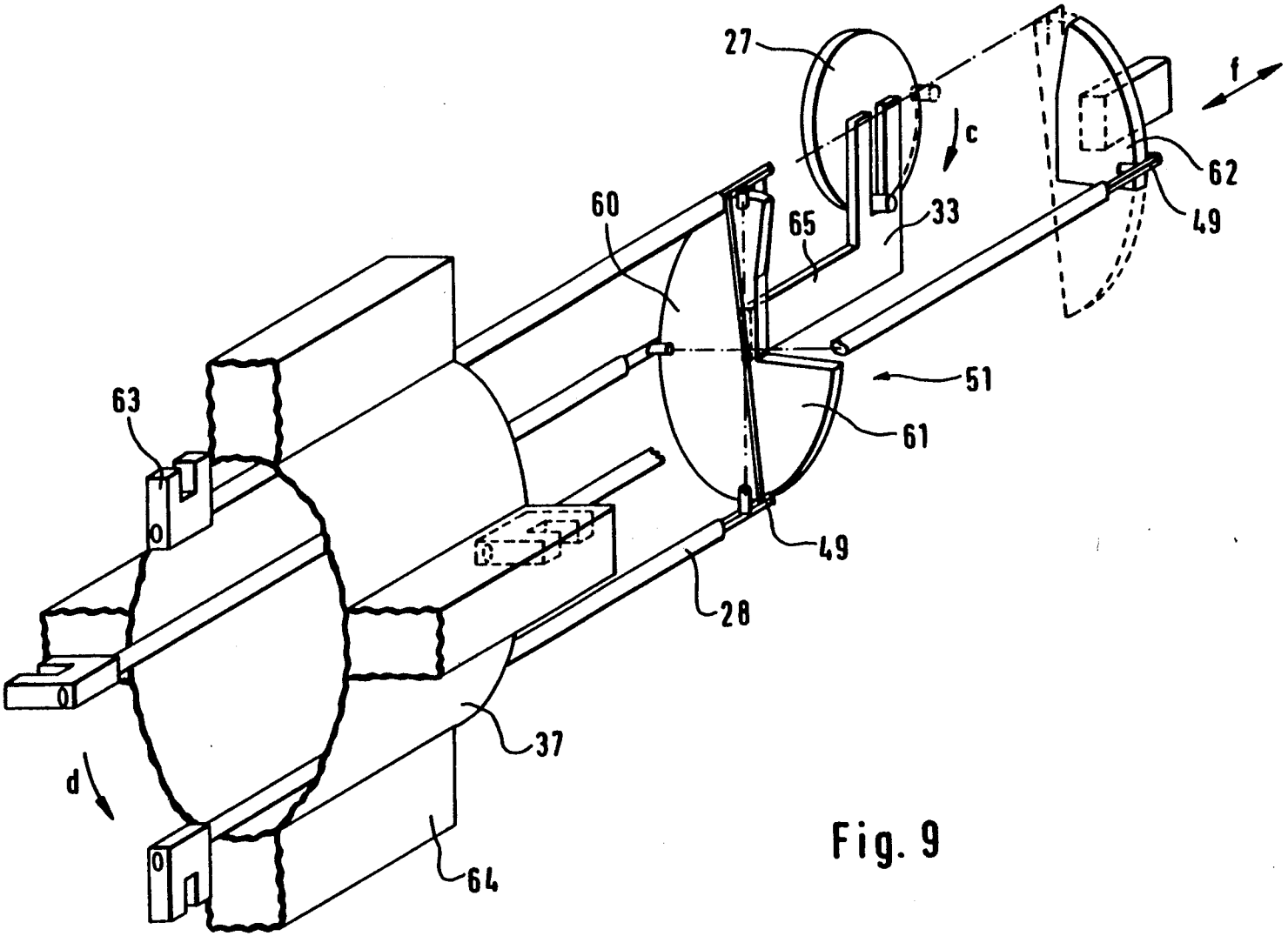
FIG. 9: a perspective portrayal of a rotor control.

FIG. 9 shows, very simplified, the rotor control which serves to activate the shaping tools in synchronization with the rotary movement of the rotor. For this purpose, a thrust rod 28 is allocated to each rotor arm 64, on the ends of which a fork 63 is arranged. Each fork 63 engages into the carrier 29 (FIG. 5) for pushing of the traction mechanism. A contact member 49, which probes a control disk 51, is arranged at the opposite end of each thrust rod 28.

The control disk 51 is subdivided into a total of three different segments. A closing segment 60 is arranged to be fixed and extends through a sector of approximately 180°. An opening segment 62, which is likewise stationary and which can, however, be displaced during operation in the direction of the arrow f, is arranged, axially offset, on the rotor axis. The opening segment 62 extends through a sector of slightly less than 90°.

The remaining sector surface of the control disk 51 is covered by a thrust segment 61 which is firmly connected to the thrust element 65 and with the vertical fork 33. Through rotation of the drive crank 27 through 90° in the direction of the arrow c, the thrust segment 61 can be pushed out of an opening position, in which it corresponds to the opening segment 62, into a closed position in which it corresponds to the closing segment 60.

During rotation of the rotor in the direction of the arrow d, the following sequence ensues: The contact member 49 fits closely on the opening segment 62 at the loading station 38. The moveable shaping tools 5 then assume the position as shown in FIG. 5, in which they are equipped with the material sheet 1. By further rotation of the rotor, the shaping tools remain in this opened position since the contact member 49 must first of all measure off along the opening segment 62 until it is guided over onto the narrow part sector of the thrust segment 61. In this position, the rotor arm concerned has reached the deforming station 39 and the lower shaping tools are positioned exactly opposite the upper shaping tools 4. Now the deformation of the material sheet will follow, in that the drive crank 27 is activated and through that the thrust segment 61 is pushed from the opening segment 62 to the closing segment 60. During this linear movement the upper and lower traction mechanisms 17, respectively 21 are activated and the shaping tools carry out the already described movement. Now the rotor rotates further through a quarter rotation, the contact member 49 crossing over to the closing segment 60 so that the shaping tools are held firmly in the closed position. At the end of this cycle, the coating station 40 is reached. After coating, a further rotation of the rotor through 90° ensues, the contact member 49 still fitting closely on the closing segment 60. Only after the combining of the shaped material sheet 1 with the carrier sheet 44, and after a further rotary movement of the rotor through a few degrees of angle, will the contact member 49 once again be transferred onto the larger part section of the thrust segment 61, which continues to wait in the same position. As soon, however, as the contact member has once again reached the thrust segment 61, the thrust segment will be returned once again, simultaneously with the rotary movement of the rotor, so that the shaping tools open once again during the rotational movement of the rotor until they have once again reached their start position. This transmission control is extremely efficient and therewith allows precise and short working cycles to be aimed for. With compensation drives, which are not further portrayed here but are however known to an expert in the art, the individual parameters of the transmission can be altered during rotation of the rotor, in order, for example, to alter the opposing penetration depth of the shaping tools.

Figure 10:
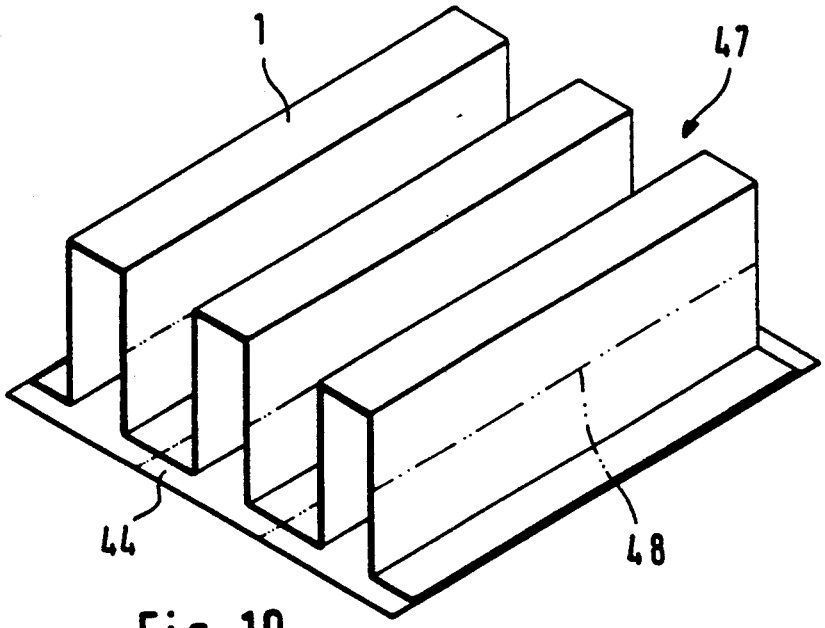
FIGS. 10 to 12: different corrugated components, which have been manufactured according to the method according to the invention.

FIG. 10 shows a typical corrugated component 47 which has been produced according to the method according to the invention. The material sheet 1 has a regular, meander shaped configuration and is very slightly narrower than the carrier sheet 44.

Figure 11:
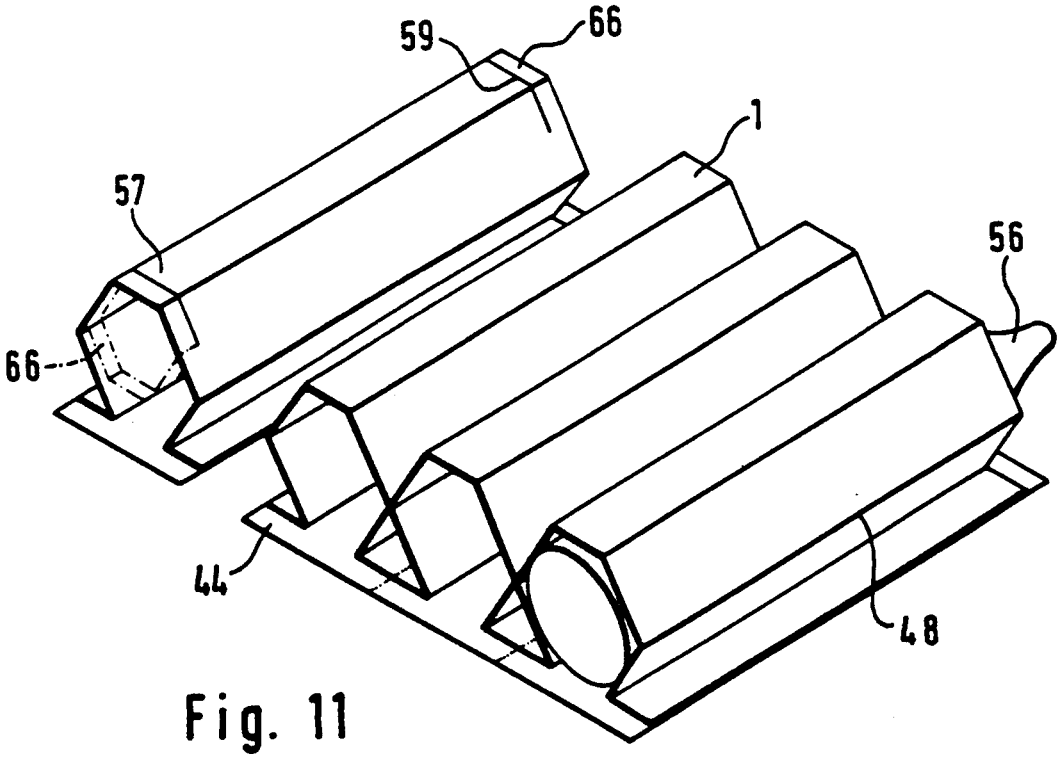

If an additional folded edge 48 is intended on the side walls of the corrugations, a honeycomb pattern is able to be made, as portrayed in FIG. 10, through pressing the corrugations together. The individual honeycombs 57 can be filled with items 56 which are, in this way, shock resistantly packed (FIG. 11).

Figure 12:
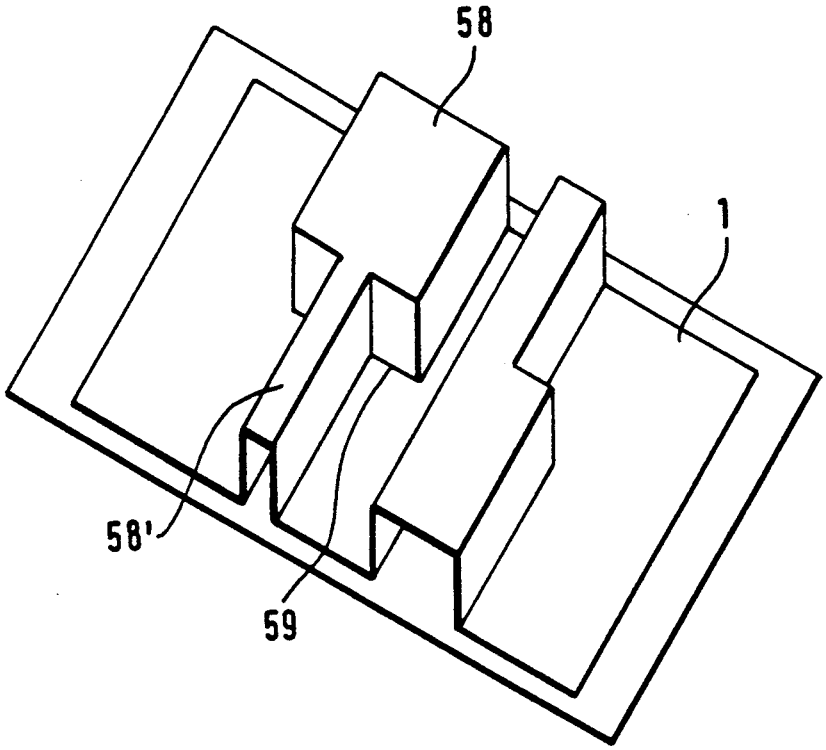

FIG. 12 shows a further modified configuration of a corrugated component with which the material sheet 1 possesses a section 58, 58' with differing cross sectional shape. This naturally presupposes that the material sheet 1 is provided with incisions 59 in order that the side walls of the section 58, 58' can be made upright. In a case such as this, naturally the shaping tools must possess a corresponding configuration.

The incisions 59 can, however, also serve the purpose of cutting fold-out webs out of the individual chambers, in order to achieve the securing of an item. So, for example in the case of honeycomb packaging according to FIG. 11, in each case a material web is cut out near both the facing side openings of a chamber, and is folded over towards the centre of the chamber after filling, by which means the item 56 is provided with a mechanical stop on both its ends. An example of this type of web 66 is portrayed on the outermost left honeycomb.

What is claimed is:

1. A method for corrugated deformation of a flat material sheet (1) comprising steps of:

providing a first row (2) of approximately prismatic, parallel shaping tools, and a second row (3) of approximately prismatic, parallel shaping tools adapted to intermesh with the tools of said first row, said second row of tools being parallel to said first row, and at least one of said rows being movable in a direction toward the other row to an intermeshed position, loading said sheet between said rows while said rows are in a non-intermeshed loading position, moving said second row of tools toward the first row to deform the sheet, while simultaneously, within each of said rows, closing the spacing between adjacent tools so that no relative movement takes place between the facing surfaces (6) of the shaping tools and the material sheet (1) during the deformation, and then moving one of said rows of tools and the deformed sheet therewith along a path to a depositing position, in which the material sheet is discharged.

2. Method according to claim 1, wherein the deformed material sheet is connected with a carrier sheet (44) in the depositing position.

3. Method according to claim 2, wherein the deformed material sheet is coated with an adhesive in a coating position which lies between the deforming position and the depositing position.

4. Method according to claim 1, wherein the material sheets are held fast through vacuum on the facing sides of the lower row of shaping tools during transport to the different position.

5. Method according to claim 1, wherein the shaping tools (4, 5) of both the rows (2, 3) are pushed, each by a traction mechanism (17, 21) with a parallel running means of traction (18, 19, 22, 23).

6. Method according to claim 1, wherein the shaping tools (4, 5) of both the rows (2, 3) are driven directly or indirectly through a crank drive.

7. Method according to claim 1, wherein the second row (3) of shaping tools is rotated cyclically on a rotor into the different positions.

8. A device for corrugated deformation of a flat material sheet (1), comprising a first row (2) of approximately prismatic, parallel shaping tools, a second row (3) of approximately prismatic, parallel shaping tools adapted to intermesh with the tools of said first row, said second row of tools being parallel to said first row, each of said tools in a respective row having a surface facing the other row, the tools within each row being movable with respect to one another to close their spacing so that no relative displacement takes place between the facing surfaces of the shaping tools and the material sheet (1) during the deformation, one of said rows of tools being movable in a direction toward the other row at a deformation station, and one of said rows of tools being movable, together with the material sheet, between different work stations.

9. Device according to claim 8, wherein the second row (3) of shaping tools (5) is arranged on a rotor (37) which is able to be rotated cyclically in the region of the working stations.

10. Device according to claim 9, wherein a loading station (38), for the placing of the flat material sheets (1) onto the facing sides (6) of the shaping tools (5), is arranged in the region of rotation of the second row before the deforming station (39), and a depositing station (41), for depositing the deformed material sheets, is arranged after the deforming station (39).

11. Device according to claim 10, wherein the depositing station (41) is arranged above a means of supply (43) for the delivery of a carrier sheet (44).

12. Device according to claims 10 or 11, wherein a coating station (40), for coating the material sheet with an adhesive, is arranged between the deforming station (39) and the depositing station (41).

13. Device according to claim 9, wherein at least four rows of shaping tools are arranged on the rotor (37) at regular angular intervals and that respectively one working step is able to be carried out simultaneously at each working station.

14. Device according to claim 9, wherein the facing sides (6) of the second row (3) of shaping tools (5) is provided with openings (7) which act in coordination with a vacuum scource.

15. Device according to claim 9, wherein the shaping tools of both the rows are each guided in a linear guide (12, 13) and that they are each connected with a traction mechanism (17, 21) with parallel running means of traction (18, 19, 22, 23).

16. Device according to claim 9, wherein the shaping tools of both the rows are able to be driven through at least one crank drive which coordinates the movement of the pushing together of the individual shaping tools and/or the movement of the pressing of both the rows against one another.

17. Device according to claim 9, wherein the relative position of the shaping tools on the rotor is able to be controlled through a control disk which is arranged at right angles to the rotational axis and which is divided into at least three separate segments and which is able to be probed on its circumferential area by a contact member allocated to each row of shaping tools, two segments for the open, respectively the closed position of the shaping tools being arranged axially offset in relation to one another, and one segment being arranged to be axially displaceable for carrying out the opening, respectively the closing movement and for transfer of the contact member onto the fixed segments.

18. Device according to claim 17, wherein the distance between the segments, which are arranged to be axially offset, is able to be adjusted.

* * * * *